United States Patent [19]

Hennessy

[11] 4,272,974

[45] Jun. 16, 1981

[54] DEAD BOLT LOCK

[75] Inventor: Thomas F. Hennessy, Bristol, Conn.

[73] Assignee: Lori Engineering Corporation, Southington, Conn.

[21] Appl. No.: 6,564

[22] Filed: Jan. 25, 1979

[51] Int. Cl.[3] ..... E05B 9/06; E05B 65/06; E05C 1/06

[52] U.S. Cl. ..... 70/129; 70/134; 70/370; 70/450; 70/451

[58] Field of Search ..... 70/129, 134, 449, 450, 70/451, DIG. 57, 370, 461, 462

[56] References Cited

U.S. PATENT DOCUMENTS

| | | | |
|---|---|---|---|
| 1,846,364 | 2/1932 | Schlage | 70/134 X |
| 2,042,021 | 5/1936 | Schlage | 70/129 X |
| 2,357,552 | 9/1944 | Schlage | 70/450 X |
| 3,011,817 | 12/1961 | Eads | 70/134 X |
| 3,036,850 | 5/1962 | Schmid | 70/450 X |
| 3,606,422 | 9/1971 | Hennessy | 70/129 X |
| 3,699,788 | 10/1972 | Gerlach et al. | 70/134 |
| 3,948,066 | 4/1976 | Solovieff | 70/129 |
| 3,950,974 | 4/1976 | Alexander | 70/450 |
| 3,992,908 | 11/1976 | Crepinsek | 70/370 |

FOREIGN PATENT DOCUMENTS

| | | | |
|---|---|---|---|
| 97092 | 5/1924 | Austria | 70/370 |
| 374671 | 5/1923 | Fed. Rep. of Germany | 70/449 |
| 812296 | 4/1959 | United Kingdom | 70/451 |
| 1414273 | 11/1975 | United Kingdom | 70/451 |

*Primary Examiner*—Roy D. Frazier
*Assistant Examiner*—Carl F. Pietruszka
*Attorney, Agent, or Firm*—Fishman and Van Kirk

[57] ABSTRACT

A key operated dead bolt lock includes one or a pair of standard threaded mortise cylinders. The lock further includes set screws, inaccessible from either side of a door in which the lock is installed, which prevent rotation of the cylinders. The cylinders hold cylinder collars in place to prevent access to the bolt from the side.

16 Claims, 3 Drawing Figures

3
3
A

DEAD BOLT LOCK

BACKGROUND OF THE INVENTION (1) Field of the Invention

The present invention relates to preventing unauthorized access to areas and particularly to the locking of doors. More specifically, this invention is directed to a dead bolt lock. Accordingly, the general objects of the present invention are to provide novel and improved methods and apparatus of such character.

(2) Description of the Prior Art

There is, in the art, a demand for dead bolt type locks which may be installed in doors or the like and operated from one or both sides of the door by means of a key. Prior dead bolt locks are characterized by rim cylinders with exposed or weakly shielded attaching screws. The use of such attaching screws significantly reduces the security of the lock. The rim cylinders employed in prior dead bolt locks also have the deficiency of employing "lazy cam" tailpieces which are unique to their respective lock and which are often flimsy in their construction. Further, rim cylinders employed in prior dead bolt locks, because of the use of "lazy cam" mechanisms, are relatively long and thus require extended cylinder collars that protrude from the door and are subject to vandalism.

SUMMARY OF THE INVENTION

The present invention provides a dead bolt lock which employs one or a pair of standard threaded mortise cylinders. Thus, a lock in accordance with the present invention does not require attaching screws thereby eliminating the security problems incident to use of exposed or thinly shielded attaching screws. Also, by virtue of the use of a standard mortise cylinder, locks in accordance with the present invention employ a cam type operator, rather than a "lazy cam" tailpiece, and the locks of the present invention are thus more rugged and shorter in length when compared to the prior art. The reduction in length, in turn, reduces the projection of the cylinder collar and minimizes the susceptibility of the present locks to vandalism.

Locks in accordance with the present invention are also characterized by cylinder set screws, accessible only from the end of the door, which prevent the rotation of the threaded mortise cylinder. The cylinder set screws are shielded by an armored front which can be removed only when the door is open; removal of the armored front permitting insertion of a hexagonal shaped wrench to loosen the cylinder set screws.

A lock in accordance with the present invention is also characterized by a two piece bolt guide having a self-locating flange plate whereby the front support for the lock will always install flat against the bevelled end of the door in which the lock is mounted.

To further describe a lock in accordance with a preferred embodiment of the invention, the lock comprises at least a first standard threaded mortise cylinder which includes a rotatable cam protruding from the surface thereof opposite to the key receiving end of the cylinder. This cam is movable through an arc in response to the turning of a key inserted into the cylinder whereby the cam will wipe across a bolt operating pin to thus actuate a bolt between an extended position and a withdrawn position. The bolt is included in a subassembly which comprises a tubular bolt guide which receives the bolt in the withdrawn position. The mechanism for actuating the bolt extends into the bolt guide and includes a pivotal lever. The bolt operating pin is attached to a first free end of the lever and functions as a cam follower which is contacted and operated by the cam on the mortise cylinder. The second free end of the lever, which is located at the opposite side of the pivot point of the lever with respect to the operating pin, includes a further pin which moves in an elongated actuation slot. This further pin is coupled to the bolt by means of a connecting rod whereby movements of the bolt will follow movements of the lever and thus will follow rotation of the mortise cylinder cam. The bolt is spring biased so as to cause the further pin to be received in an angled extension of the actuation slot whereby forcing of the bolt from the extended to withdrawn position is impeded.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figures 1, 3:
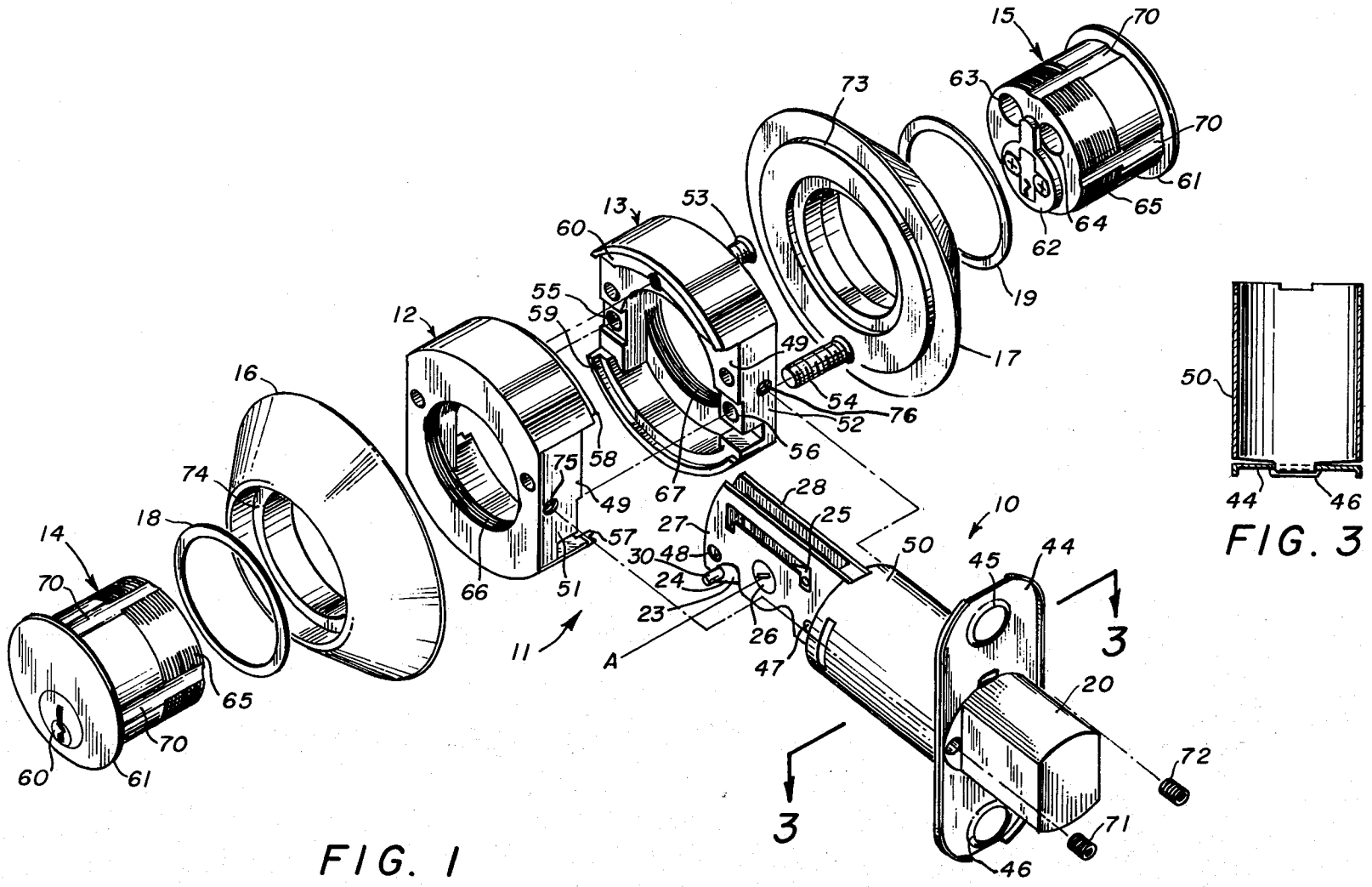
FIG. 1 is an exploded perspective view of a preferred embodiment of a dead bolt lock in accordance with the present invention.
FIG. 3 is a cross-sectional top view, taken along line 3—3 of FIG. 1, of the bolt housing of the embodiment of FIG. 1.

With reference to FIG. 1, a dead bolt lock in accordance with a preferred embodiment of the present invention includes a bolt subassembly, indicated generally at 10, and a cylinder housing which has been indicated generally at 11. The cylinder housing 11 is separable into two halves which have been indicated generally at 12 and 13. In the disclosed embodiment of the invention, the bolt will be key operated from either side and thus the housing halves 12 and 13 will be internally threaded to respectively receive standard externally threaded mortise cylinders 14 and 15. It will be understood that one of the cylinders, typically the cylinder on the inside of the door, may be replaced by an appropriate key-less actuator. As will be described in more detail below, when the lock is assembled the cylinders 14 and 15, by virtue of the flanges 61 at the front ends thereof, will hold respective cylinder collars or "roses" 16 and 17 against the oppositely facing surfaces of a door. Wave washers 18 and 19 will customarily be provided intermediate the flanges of respective cylinders 14 and 15 and cylinder collars 16 and 17 to permit compensation for variations in door thickness.

Figure 2:
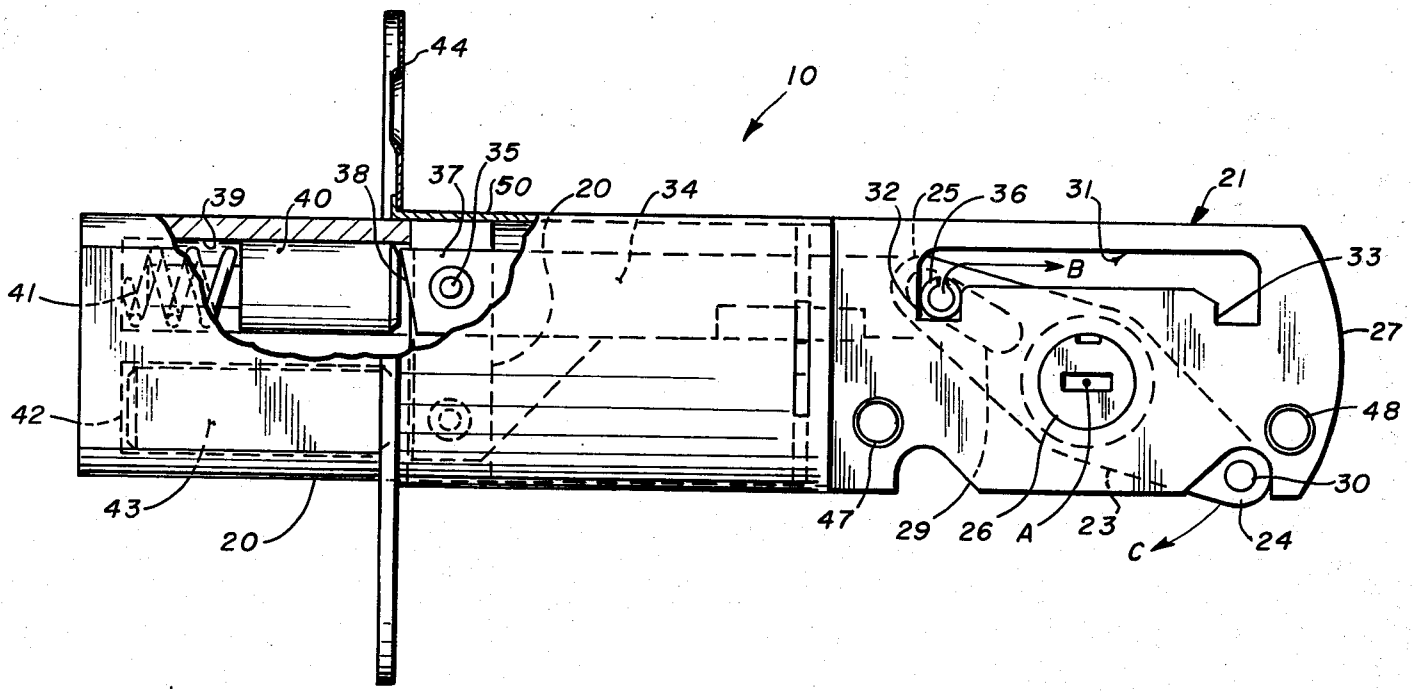
FIG. 2 is a side plan view, partly in section, of the bolt subassembly of the lock of FIG. 1.

Referring now simultaneously to FIGS. 1 and 2, bolt subassembly 10 includes a bolt 20 which has been shown in the extended position. When operated, in the manner to be described below, bolt 20 will be retracted into a tubular bolt guide 50. The means by which retraction of the bolt is accomplished includes a lever 23 which is mounted on a rotatable hub 26. Lever 23, in a preferred embodiment, consists of a pair of parallel plates held together by hub 26 and a cam follower pin 30. Hub 26 also extends through a pair of parallel, spacially displaced plates 27 and 28. Plates 27 and 28 define an actuator housing, indicated generally at 21 in FIG. 2, which is received in tubular bolt guide 50 at the end thereof opposite to the bolt receiving end. Lever 23 is pivotal about the axis of hub 26, indicated at A, which is located intermediate the ends 24 and 25 of the lever. Lever 23 includes, extending from a point adjacent end 25 thereof toward hub 26, an elongated slot 29. The cam follower pin 30 extends transversely in both directions from lever 23 at a point adjacent end 24 thereof. In the disclosed embodiment, pin 30 is of cylindrical shape.

Continuing with a discussion of the bolt subassembly, the plates 27 and 28 are staked together and are provided with aligned guide slots, indicated generally at 31 in FIG. 2, which extend generally parallel to the direction in which the bolt 20 travels. A first guide slot extension 32 extends downwardly from the forward end of guide slot 31 and provides a mechanism which prevents the forced retraction of bolt 20 from the extended position shown in the drawing to the withdrawn position. Optionally, the bolt subassembly may include a second guide slot extension 33 which projects downwardly from the rearwardly disposed end of slot 31. Guide slot extension 33, if present, prevents bolt 20 from being inadvertently extended when the bolt is in the withdrawn position. The manner in which the guide slot 31 and its extensions 32 and 33 perform their intended functions will be described below.

The first end of a connecting rod 34 is attached to the inwardly disposed end of bolt 20 by means of a pivot pin 35. The second end of connecting rod 34, which extends into the space between plates 27 and 28, includes a transversely extending pin 36 which rides in both of slots 29 and 31 as shown in FIG. 2. The first end 37 of connecting rod 34 is provided with an angled camming surface 38. A cylindrical recess 39, in the form of a blind hole, is provided in the rearwardly facing end of bolt 20. A cylindrical cam 40 is positioned in recess 39 and is spring loaded toward the rear of the bolt by means of a compression spring 41. Thus, spring 41 urges cam 40 to the right, as the lock is shown in FIG. 2, and against the camming surface 38 of rod 34. The force of spring 41 is thus transmitted to rod 34 and biases the rod in a clockwise direction about the pivot pin 35. Accordingly, when pin 36 is aligned with either of the extensions 32 or 33 of guide slot 31, the pin will be urged downwardly into the slot extension.

In order to operate bolt 20 from the extended position to the retracted position, the cam follower pin 30 is driven in the direction indicated by arrow C in FIG. 2. Imparting of motion to cam follower pin 30 will cause lever 23 to pivot about axis A whereby pin 36 will be moved upwardly out of slot extension 32 and, subsequently, pin 36 may travel linearly along slot 31 as indicated by arrow B in FIG. 2. The force imposed upon lever 23 via cam follower pin 30 must, of course, overcome the downward bias on pin 36 provided by spring 41 in order for the pin to be removed from the guide slot extension 32. As lever 23 is rotated from the position shown in FIG. 2 to a position where bolt 20 is withdrawn, pin 36 will move to the rearwardly disposed end of slot 31. If slot 33 is present, when pin 36 reaches its rearward limit of travel, the angular bias imposed on rod 34 by spring 41 via cam 40 will cause pin 36 to move downwardly into guide slot extension 33.

When bolt 20 is in the extended position shown in the drawing, and a force is applied to the bolt in an attempt to defeat the lock and cause the bolt to move to the withdrawn position, pin 36 will contact the forwardly facing wall of slot extension 32 and the bolt will not move. As previously described, this safety feature results from the biasing action of spring 41, cam 40 and angled face 38 of rod 34.

Bolt 20 also includes a second blind hole or chamber 42 which houses a case hardened cylindrical member 43. Member 43 will inhibit the cutting of bolt 20 in an effort to defeat the lock.

Referring jointly to FIGS. 1-3, the bolt guide 50 is provided with a bevelled front surface as can best be seen from FIG. 3. A front flange plate 44 is loosely connected to bolt guide 50 and extends outwardly therefrom as shown in FIGS. 2 and 3. Attachment of plate 44 to tube 50, to form a two piece bolt guide, is typically by means of a pair of tabs on the front end of tube 50; these tabs engaging plate 44 at the top and bottom of the passage in which the bolt moves. Plate 44 is provided with apertures 45 and 46 by which the bolt subassembly 10 may be attached to a door. Unlike prior locks wherein the bolt guide tube 50 and flange 44 are a rigid subassembly, in the present invention the bevelled front surface of the bolt guide tube permits the flange plate to have a limited degree of side-to-side movement. Thus, the plate 44 can self-locate on the end of a door. As is well known, most doors are provided with bevelled ends to facilitate opening and closing. An armored front, not shown, having apertures which match holes 45 and 46 in plate 44 will be provided as a part of the lock. This armored front will have a center aperture therein which closely approximates the shape of bolt 20 whereby access to a pair of set screws 71 and 72, the purpose of which will be described below, will not be possible without first removing the attachment screws which hold the armored front on plate 44.

Plates 27 and 28 of actuator housing 21 are provided with aligned through holes which receive spacer bushings 47 and 48. The bolts 53, 54 which hold the halves 12 and 13 of housing 11 together will pass through bushings 47 and 48.

Referring again to FIG. 1, when the lock is assembled the actuator housing 21 defined by plates 27 and 28 of the bolt subassembly are received in housing 11. For this purpose, the halves 12 and 13 of housing 11 define an opening 49 which receives housing 21. The tubular bolt guide 50 abuts, at its inwardly disposed end, flat surfaces 51 and 52 respectively provided on the halves 12 and 13 of housing 11. In the embodiment shown, housing portions 12 and 13 are secured to one another by means of three screws; two of which 53 and 54 have been shown. Bolts 53 and 54 respectively pass through holes 55 and 56 in portions 13 of housing 11, thereafter pass through aforementioned bushings 47 and 48 in the bolt subassembly and then engage portion 12 of housing 11. A third bolt, which does not pass through the bolt subassembly, will be factory installed and will retain the halves of housing 11 together prior to installation of the lock in a door. In the disclosed embodiment, the portions 12 and 13 of housing 11 are fitted together in a tongue and groove arrangement.

It should be noted that the lock of the present invention may be employed with standard door preparation wherein a pair of transverse holes are bored. That is, the lock of the present invention may be installed in any door which has been prepared to receive a standard tubular dead bolt or knob set lock. When cylinder housing 11 has been installed from the side of the door, the bolt subassembly 10 will be inserted from the edge and, when the holes which receive the bolts 53 and 54 are aligned, the bolts will be inserted and the bolt subassembly thus attached to the cylinder subassembly. Thereafter, when the mortise cylinders 14 and 15 are inserted, the bolts 53 and 54 will be positioned behind "rose" 17 and thus an armored installation results. This may be contrasted to the prior art wherein either the bolts were exposed or only thin, easily defeated shields were utilized.

The mortise cylinders 14 and 15 each include a rotatable cam 62 as shown on cylinder 15 in FIG. 1. Cam 62 may be rotated in response to the insertion of a key in the lock; keyhole 60 being shown in the case of cylinder 14 on FIG. 1. The bodies of cylinders 14 are externally threaded, as previously mentioned, so that the cylinders will be engaged in the housing 11. The external surfaces of the cylinders include elongated detents 70 which receive the aforementioned set screws 71 and 72; screws 71 and 72 respectively being received in threaded holes 75 and 76 which are respectively provided in the flat side portions 51 and 52 of respective of housing portions 12 and 13. In the course of assembly of a lock in accordance with the present invention, as the lock is being installed in a door, the set screws 71 and 72 will be tightened against the sides of the mortise cylinders by insertion of an appropriate tool along the sides of bolt 20. The engagement of the ends of screws 71 and 72 with the detents 70 in the cylinders will prevent the mortise cylinders from being unscrewed from the lock assembly and this locking action will be performed prior to placing the armored front into abutting contact with flange plate 44 and thereafter inserting the screws which secure the bolt subassembly to the end of the door. The cylinder collars 16 and 17 are, in the embodiment shown, provided with annular inwardly extending portions 73 which mate with the hole drilled in the door for receiving the cylinder housing 11. The aforementioned wave washers 18 and 19 are received within the guard plates 16 and 17 and abut an internal flange provided therein; an internal flange 74 being visible on cylinder collar 16. With the lock assembled, the flanges 61 on the mortise cylinders will customarily abut the wave washers 18 and 19. The faces of the mortise cylinders will, as a consequence of the compressive force imposed on the wave washers 18 and 19 by the mortise cylinders, either be flush with or recessed into the guard plates.

In operation of the lock, by means of a key inserted in one of the mortise lock cylinders, the cam 62 will be rotated with the key and will wipe across the cam follower pin 30 thus urging the cam follower downwardly and either forwardly or rearwardly depending upon whether the bolt is being retracted or extended. The manner in which the motion of the cam follower 30 is transmitted to the bolt has been described above.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A key operable dead bolt lock comprising:

housing means, said housing means defining a first axis which will be generally transverse to the plane defined by the face of a door in which the lock is installed, said housing means further defining a bolt means receiving passage which is transverse to and intersects said first axis;

at least a first key operated actuator means, said first actuator means having an axis and being releasably received in said housing means coaxially with said first axis, said actuator means having a rotatable cam means extending from a first end thereof, said cam means being rotated in response to rotation of a removable key, said first actuator means first end being disposed oppositely to the key receiving end of said first actuator means;

elongated bolt means, said bolt means having an axis and including a retractable bolt which may be extended from a first end of said bolt means, the second end of said bolt means being received in said housing means passage, said bolt means second end intersecting said housing means first axis;

means for releasably securing said bolt means to said housing means;

lever means, said lever means being pivotally supported on said bolt means second end;

cam follower means mounted on said lever means, said cam follower means being positioned for engagement by said first actuator means cam means whereby rotation of a key received in said first actuator means will be translated into motion of said lever means, said cam follower means being moved to opposite sides of a first plane through said housing means first axis and transverse to said bolt means axis by said cam means;

means coupling said lever means to said bolt means bolt whereby said bolt will be extended and retracted in accordance with the movements of said lever means; and means for locking said first actuator means in said housing means.

2. The apparatus of claim 1 wherein said first actuator means comprises an externally threaded mortise cylinder.

3. The apparatus of claim 2 wherein said cylinder has an axis and wherein said bolt means defines an axis which is substantially transverse to an extension of said cylinder axis.

4. The apparatus of claim 2 wherein said housing means has an internally threaded bore for receiving said cylinder and wherein said lock further comprises:

cylinder collar means, said collar means being held in position against the face of a door in which the lock is installed by the interaction of said threaded housing bore and cylinder, said collar means preventing access to said housing means from the face of the door when the cylinder is installed.

5. The apparatus of claim 1 wherein said securing means comprises:

at least a pair of removable fasteners which engage said housing means, said fasteners also engaging said bolt means at least at two points displaced to opposite sides of said first plane.

6. The apparatus of claim 2 wherein said housing means defines an internally threaded bore for receiving said cylinder, said passage intersecting said bore, and wherein said locking means comprises:

at least a first threaded hole in said housing means, said hole intersecting said bore and being offset along said bore with respect to said passage;

a set screw positioned in said hole, access to said set screw being afforded adjacent to said bolt means bolt; and a detent in the exterior surface of said cylinder, engagement of an end of said set screw with said cylinder detent preventing rotation of said cylinder.

7. The apparatus of claim 6 further comprising:

cylinder collar means, said collar means being held in position against the face of a door in which the lock is installed by the interaction of said threaded housing bore and cylinder, said collar means preventing access to said housing means from the face of the door when the cylinder is installed.

8. The apparatus of claim 7 wherein said securing means comprises:

at least a pair of removable fasteners which engage said housing means, said fasteners also engaging said bolt means at least at two points displaced to opposite sides of said first plane.

9. The apparatus of claim 1 wherein said bolt means comprises:

a tubular bolt guide, said guide having an axis which is coaxial with said bolt means axis;

a longitudinally movable bolt at least in part positioned in said guide, said bolt having flat portions on a pair of opposed sides thereof whereby spaces are left between said bolt and the interior of said bolt guide; and a flange plate mechanically connected to and extending from a first end of said bolt guide, said flange plate defining a second plane oriented generally transversely with respect to the axis of said guide, said flange plate being capable of limited pivotal motion about said guide first end whereby said second plane may be angularly adjusted with respect to said first plane in a first direction.

10. The apparatus of claim 9 wherein said guide first end has oppositely disposed arcuate recesses extending inwardly from the top and bottom sides thereof so as to permit said pivotal motion.

11. The apparatus of claim 6 wherein said bolt means comprises:

a tubular bolt guide, said guide having an axis, said guide axis forming said bolt means axis;

a longitudinally movable bolt at least in part positioned in said guide; and a flange plate mechanically connected to and extending outwardly from a first end of said guide, said flange plate defining a second plane and being capable of limited pivotal movement about top and bottom portions of said guide first end whereby said second plane may be angularly adjusted in a first direction relative to said first plane.

12. The apparatus of claim 11 wherein said bolt is provided with flats on opposite sides thereof, spaces being defined between said flats and the interior of said guide, access to said set screw being via insertion of a tool in one of said spaces in a direction parallel to said guide axis.

13. The apparatus of claim 12 wherein said flange plate defines a receptacle for an armour plate which will cover said spaces and wherein said flange plate is provided with apertures for receiving mounting screws whereby said guide may be secured to the end of a door.

14. The apparatus of claim 13 further comprising:

cylinder collar means, said collar means being held in position against the face of a door in which the lock is installed by the interaction of said threaded housing bore and cylinder, said collar means preventing access to said housing means from the face of the door when the cylinder is installed.

15. The apparatus of claim 14 wherein said securing means comprises:

at least a pair of removable fasteners which engage said housing means, said fasteners also engaging said bolt means at least at two points displaced to opposite sides of said first plane.

16. The apparatus of claim 4 wherein said securing means comprises:

at least a pair of removable fasteners which engage said housing means, said fasteners also engaging said bolt means at least at two points displaced to opposite sides of said first plane.

* * * * *